US009932656B2

(12) United States Patent
Hattendorf et al.

(10) Patent No.: US 9,932,656 B2
(45) Date of Patent: Apr. 3, 2018

(54) NICKEL-BASED ALLOY WITH SILICON, ALUMINUM, AND CHROMIUM

(71) Applicant: VDM Metals International GmbH, Werdohl (DE)

(72) Inventors: Heike Hattendorf, Werdohl (DE); Frank Scheide, Altena (DE); Larry Paul, Bluffton, SC (US)

(73) Assignee: VDM Metals International GmbH, Werdohl (DE)

( * ) Notice: Subject to any disclaimer, the term of this patent is extended or adjusted under 35 U.S.C. 154(b) by 399 days.

(21) Appl. No.: 14/772,161

(22) PCT Filed: Jan. 28, 2014

(86) PCT No.: PCT/DE2014/000034
§ 371 (c)(1),
(2) Date: Sep. 2, 2015

(87) PCT Pub. No.: WO2014/139490
PCT Pub. Date: Sep. 18, 2014

(65) Prior Publication Data

US 2016/0032425 A1 Feb. 4, 2016

(30) Foreign Application Priority Data

Mar. 14, 2013 (DE) ..... 10 2013 004 365

(51) Int. Cl.
*C22C 19/05* (2006.01)
*H01T 13/39* (2006.01)

(52) U.S. Cl.
CPC ..... *C22C 19/057* (2013.01); *C22C 19/058* (2013.01); *H01T 13/39* (2013.01)

(58) Field of Classification Search
CPC ..... C22C 19/057
See application file for complete search history.

(56) References Cited

U.S. PATENT DOCUMENTS

| | | | |
|---|---|---|---|
| 4,329,174 | A | 5/1982 | Ito et al. |
| 7,866,294 | B2 | 1/2011 | Lykowski et al. |
| 8,784,730 | B2 | 7/2014 | Hattendorf |
| 8,816,577 | B2 | 8/2014 | Ma et al. |
| 2004/0013560 | A1 | 1/2004 | Hrastnik |
| 2010/0003163 | A1 | 1/2010 | Kloewer et al. |
| 2012/0217433 | A1 | 8/2012 | Yokoyama et al. |
| 2013/0078136 | A1 | 3/2013 | Hattendorf |
| 2013/0200774 | A1 | 8/2013 | Kikai et al. |

FOREIGN PATENT DOCUMENTS

| | | | |
|---|---|---|---|
| CN | 102947474 | A | 2/2013 |
| DE | 29 36 312 | A1 | 3/1980 |
| DE | 102 24 891 | A1 | 12/2003 |
| DE | 10 2006 035 111 | A1 | 2/2008 |
| DE | 10 2010 024 488 | A1 | 12/2011 |
| EP | 1 867 739 | A1 | 12/2007 |
| JP | S55-44502 | A | 3/1980 |
| JP | S60-43897 | A | 3/1985 |
| JP | H04-45239 | A | 2/1992 |
| JP | 2009-544855 | A | 12/2009 |
| JP | 2010-530609 | | 9/2010 |
| JP | 2013-502044 | A | 1/2013 |
| WO | 00/00652 | A1 | 1/2000 |
| WO | 2008/014741 | A1 | 2/2008 |
| WO | 2011/160617 | A2 | 12/2011 |
| WO | 2012/086292 | A1 | 6/2012 |

OTHER PUBLICATIONS

International Search Report of PCT/DE2014/000034, dated May 8, 2014.

"Drahte von ThyssenKrupp VDM Automobilindustrie" ("Wire from ThyssenKrupp VDM, Automotive Industry"), Jan. 2006 Edition, pp. 1-26.

*Primary Examiner* — Jessee Roe

(74) *Attorney, Agent, or Firm* — Collard & Roe, P.C.

(57) ABSTRACT

A nickel-based alloy, consisting of (in mass %) 1.5-3.0% Si, 1.5-3.0% Al, and >0.1-3.0% Cr, where Al+Si+Cr is ≥4.0 and ≤8.0 for the contents of Si, Al, and Cr in %; 0.005-0.20% Fe, 0.01-0.20% Y, and <0.001-0.20% of one or more the elements Hf, Zr, La, Ce, Ti, where Y+0.5*Hf+Zr+1.8*Ti+0.6*(La+Ce) is ≥0.02 and ≤0.30 for the contents of Y, Hf, Zr, La, Ce, and Ti in %; 0.001-0.10% C; 0.0005-0.10% N; 0.001-0.20% Mn; 0.0001-0.08% Mg; 0.0001-0.010% O; max. 0.015% S; max. 0.80% Cu; Ni remainder; and the usual production-related impurities.

20 Claims, No Drawings

NICKEL-BASED ALLOY WITH SILICON, ALUMINUM, AND CHROMIUM

CROSS REFERENCE TO RELATED APPLICATIONS

This application is the National Stage of PCT/DE2014/000034 filed on Jan. 28, 2014, which claims priority under 35 U.S.C. § 119 of German Application No. 10 2013 004 365.4 filed on Mar. 14, 2013, the disclosure of which is incorporated by reference. The international application under PCT article 21(2) was not published in English.

The invention relates to a nickel-based alloy containing silicon, aluminum, chromium and reactive elements as alloy components.

Nickel-based alloys are used, among other purposes, to produce electrodes of ignition elements for internal combustion engines. These electrodes are exposed to temperatures between 400° C. and 950° C. In addition, the atmosphere fluctuates between reducing and oxidizing conditions. This results in a material destruction or a material loss due to high-temperature corrosion in the surface region of the electrodes. The generation of the ignition spark leads to a further stress (spark erosion). Temperatures of several 1000° C. occur at the base of the ignition spark, and currents as high as 100 A flow in the initial nanoseconds of a breakdown. During every spark discharge, a limited material volume in the electrodes is melted and partly vaporized, leading to a material loss.

In addition, vibrations from the engine increase the mechanical stresses.

An electrode material should have the following properties:

A good resistance to high-temperature corrosion, especially oxidation, but also to sulfidation, carburization and nitridation. Also, resistance to the erosion caused by the ignition sparks is required. In addition, the material should not be sensitive to thermal shock and should be heat-resisting. Furthermore, the material should have a good thermal conductivity, a good electrical conductivity and a sufficiently high melting point. It should be readily amenable to processing and inexpensive.

In particular, nickel alloys have to satisfy a good potential of this properties spectrum. In the comparison with noble metals they are inexpensive, do not exhibit any phase transformations up to the melting point, such as cobalt or iron, are comparatively insensitive to carburization and nitridation, have a good heat resistance, a good corrosion resistance and are readily formable and weldable.

For both damage-causing mechanisms, namely the high-temperature corrosion and the spark erosion, the type of oxide-layer formation is of special importance.

In order to achieve an optimal oxide-layer formation for the specific application, various alloying elements are known for nickel-based alloys.

In the following, all concentration values are in mass %, unless otherwise noted expressly.

DE 2936312 A1 discloses a nickel alloy consisting of approximately 0.2 to 3% Si, approximately 0.5% or less Mn, at least two metals selected from the group consisting of approximately 0.2 to 3% Cr, approximately 0.2 to 3% Al and approximately 0.01 to 1% Y, rest nickel.

DE A 10224891 proposes a nickel-based alloy that contains 1.8 to 2.2% silicon, 0.05 to 0.1% yttrium and/or hafnium and/or zirconium, 2 to 2.4% aluminum, rest nickel.

EP 1867739 A1 proposes a nickel-based alloy that contains 1.5 to 2.5% silicon, 1.5 to 3% aluminum, 0 to 0.5% manganese, 0.05 to 0.2% titanium in combination with 0.1 to 0.3% zirconium, wherein Zr may be substituted completely or partly by double the mass of hafnium.

DE 102006035111 A1 proposes a nickel-based alloy that contains 1.2 to 2.0% aluminum, 1.2 to 1.8% silicon, 0.001 to 0.1% carbon, 0.001 to 0.1% sulfur, at most 0.1% chromium, at most 0.01% manganese, at most 0.1% Cu, at most 0.2% iron, 0.005 to 0.06% magnesium, at most 0.005% lead, 0.05 to 0.15% Y and 0.05 to 0.10% hafnium or lanthanum or respectively 0.05 to 0.10% hafnium and lanthanum, rest nickel and manufacturing-related impurities.

The brochure "Wire from ThyssenKrupp VDM Automotive Industry", January 2006 Edition, describes, on page 18, an alloy according to the prior art—NiCr2MnSi containing 1.4 to 1.8% Cr, max. 0.3% Fe, max. 0.5% C, 1.3 to 1.8% Mn, 0.4 to 0.65% Si, max. 0.15% Cu and max. 0.15% Ti.

The objective of the subject matter of the invention is to provide a nickel-based alloy with which an increase of the useful life of components manufactured therefrom occurs. This can be achieved by increasing the spark-erosion and corrosion resistance with at the same time adequate formability and weldability (processability). In particular, the alloy is intended to have a high corrosion resistance and even to exhibit an adequately high corrosion resistance toward very corrosively acting fuels, such as, for example, containing a proportion of ethanol.

The objective is accomplished by a nickel-based alloy containing (in mass %)

Si 1.5-3.0%

Al 1.5-3.0%

Cr>0.1-3.0%, wherein $4.0 \leq Al+Si+Cr \leq 8.0$ is satisfied for the contents of Si, Al and Cr in %, Fe 0.005 to 0.20%,

Y 0.01-0.20%

0.001 to 0.20% of one or more of the elements Hf, Zr, La, Ce, Ti, wherein $0.02 \leq Y+0.5*Hf+Zr+1.8*Ti+0.6*(La+Ce) \leq 0.30$ is satisfied for the contents of Y, Hf, Zr, La, Ce, Ti in %,

C 0.001-0.10%

N 0.0005-0.10%

Mn 0.001-0.20%

Mg 0.0001-0.08%

O 0.0001 to 0.010%

S max. 0.015%

Cu max. 0.80%

Ni rest and the usual manufacturing-related impurities.

Preferred configurations of the subject matter of the invention are specified in the dependent claims.

The silicon content lies between 1.5 and 3.0%, wherein defined contents may preferably be adjusted within the ranges:

1.8 to 3.0%

1.9 to 2.5%

This is similarly true for the element aluminum, which is adjusted to contents between 1.5 and 3.0%. Preferred contents may be specified as follows:

1.5 to 2.5%

1.6 to 2.5%

1.6 to 2.2%

1.6 to 2.0%

This is similarly true for the element chromium, which is adjusted to contents between >0.1 and 3.0%. Preferred contents may be specified as follows:

0.8 to 3.0%

1.2 to 3.0%

1.9 to 3.0%

1.9 to 2.5%

For the elements Al, Si and Cr, the formula $4.0 \leq Al+Si+Cr \leq 8.0$ must be satisfied for the contents of Si, Al and Cr in %. Preferred ranges are specified for $4.5 \leq Al+Si+Cr \leq 7.5\%$ $5.5 \leq Al+Si+Cr \leq 6.8\%$ The same is true for the element iron, which is adjusted to contents between 0.005 and 0.20%. Preferred contents may be specified as, follows:

0.005 to 0.10%

0.005 to 0.05%

Furthermore, it is favorable to add to the alloy yttrium with a content of 0.01% to 0.20% and 0.001 to 0.20% of one or more of the elements Hf, Zr, La, Ce, Ti wherein $0.02 \leq Y+0.5*Hf+Zr+1.8*Ti+0.6*(La+Ce) \leq 0.30$ is satisfied for the contents of Y, Hf, Zr, La, Ce, Ti in %. Preferred ranges in this case are specified as follows:

Y 0.01 to 0.15%

Y 0.02 to 0.10%

Hf, Zr, La, Ce, Ti respectively 0.001 to 0.15% with $0.02 \leq Y+0.5*Hf+Zr+1.8*Ti+0.6*(La+Ce) \leq 0.25$

Hf, Zr, La, Ce, Ti respectively 0.001 to 0.10% with $0.02 \leq Y+0.5*Hf+Zr+1.8*Ti+0.6*(La+Ce) \leq 0.20$

Hf, Zr, Ti respectively 0.01 to 0.05% or La, Ce respectively 0.001 to 0.10% with $0.02 \leq Y+0.5*Hf+Zr+1.8*Ti+0.6*(La+Ce) \leq 0.20$

Carbon is adjusted in the alloy in the same way, and specifically to contents between 0.001 and 0.10%. Preferably contents may be adjusted as follows in the alloy:

0.001 to 0.05%

Likewise nitrogen is adjusted in the alloy, and specifically to contents between 0.0005 and 0.10%. Preferably contents may be adjusted as follows in the alloy:

0.001 to 0.05%

The element Mn may be specified as follows in the alloy:

Mn 0.001 to 0.20% wherein preferably the following ranges are specified:

Mn 0.001 to 0.10%

Mn 0.001 to 0.08%

Magnesium is adjusted to contents of 0.0001 to 0.08%. Preferably the option exists of adjusting this element as follows in the alloy:

0.001 to 0.08%

Furthermore, if necessary, the alloy may contain calcium in contents between 0.001 and 0.06%.

The sulfur content is limited to max. 0.015%. Preferred contents may be specified as follows:

S max. 0.010%

The oxygen content is adjusted to a content of 0.0001 to 0.010% in the alloy. Preferably the following content may be adjusted:

0.0001 to 0.008%

The copper content is limited to max. 0.80%. A restriction as follows is preferred max. 0.50% max. 0.20%

Finally, the following elements may also be present as impurities:

Co max. 0.50%

W max. 0.02% (max. 0.10%)

No max. 0.02% (max. 0.10%)

Nb max. 0.02% (max. 0.10%)

V max. 0.02% (max. 0.10%)

Ta max. 0.02% (max. 0.10%)

Pb max. 0.005%

Zn max. 0.005%

Sn max. 0.005%

Bi max. 0.005%

P max. 0.050% (max. 0.020%)

B max. 0.020% (max. 0.010%)

The alloy according to the invention is preferably smelted openly, followed by a treatment in a VOD or VLF system. However, a smelting and casting in the vacuum is also possible. Thereafter, the alloy is cast in ingots or as continuous cast strand. If necessary, the ingot/continuous cast strand is then annealed at temperatures between 800° C. and 1270° C. for 0.1 h to 70 h. Furthermore, it is possible to resmelt the alloy additionally with ESR and/or VAR. Thereafter the alloy is worked into the desired semifinished form. For this purpose it is annealed if necessary at temperatures between 700° C. and 1270° C. for 0.1 h to 70 h, then hot-formed, if necessary with intermediate annealings between 700° C. and 1270° C. for 0.05 h to 70 h. If necessary for the cleaning, the surface of the material may be milled chemically and/or mechanically (even several times) during and/or after the hot-forming. Thereafter, if necessary, one or more cold-formings with reduction ratios of as much as 99% into the desired semifinished form may be applied, if necessary with intermediate annealings between 700° C. and 1270° C. for 0.1 h to 70 h, if necessary under shield gas, such as argon or hydrogen, for example, followed by a quenching in air, in the agitated annealing atmosphere or in the water bath. Then solution annealing is performed in the temperature range of 700° C. to 1270° C. for 0.1 min to 70 h, if necessary under shield gas, such as argon or hydrogen, for example, followed by a quenching in air, in the agitated annealing atmosphere or in the water bath. If necessary, chemical and/or mechanical cleanings of the material surface may be performed during and/or after the last annealing.

The alloy according to the invention may be manufactured and used readily in the product forms of strip, especially in thicknesses of 100 μm to 4 mm, sheet, especially in thicknesses of 1 mm to 70 mm, bar, especially in thicknesses of 10 mm to 500 mm, and wire, especially in thicknesses of 0.1 mm to 15 mm, pipes, especially in wall thicknesses of 0.10 mm to 70 mm and diameters of 0.2 mm to 3000 mm.

These product forms are manufactured with a mean grain size of 4 μm to 600 μm. The preferred range lies between 10 μm and 200 μm.

The nickel-based alloy according to the invention is preferably usable as a material for electrodes of spark plugs for gasoline engines.

The claimed limits for the alloy can therefore be justified in detail as follows:

The oxidation resistance increases with increasing Si content. A minimum content of 1.5% Si is necessary to obtain an adequately high oxidation resistance. At higher Si contents, the processability deteriorates. The upper limit is therefore set at 3.0 wt % Si.

At adequately high Si content, an aluminum content of at least 1.5% increases the oxidation resistance further. At higher Al contents, the processability deteriorates. The upper limit is therefore set at 3.0 wt % Al.

At adequately high Si content and Al content, a chromium content of at least 0.1% increases the oxidation resistance further. At higher Cr contents, the processability deteriorates. The upper limit is therefore set at 3.0 wt % Cr.

For a good oxidation resistance, it is necessary that the sum of Al+Si+Cr be higher than 4.0%, in order to ensure an adequately good oxidation resistance. If the sum of Al+Si+Cr is higher than 8.0%, the processability deteriorates.

Iron is limited to 0.20%, since this element reduces the oxidation resistance. A too-low Fe content increases the cost for the manufacture of the alloy. The Fe content is therefore higher than or equal to 0.005%.

A minimum content of 0.01% Y is necessary in order to obtain the oxidation-resistance-increasing effect of the Y. For cost reasons, the upper limit is set at 0.20%.

The oxidation resistance is further increased by addition of at least 0.001% of one or more of the elements Hf, Zr, La, Ce, Ti, wherein Y+0.5*Hf+Zr+1.8*Ti+0.6*(La+Ce) must be higher than or equal to 0.02, in order to obtain the desired oxidation resistance. The addition of at least one or more of the elements Hf, Zr, La, Ce, Ti by more than 0.20% increases the costs, wherein Y+0.5*Hf+Zr+1.8*Ti+0.6*(La+Ce) is additionally limited to lower than or equal to 0.30 (with the contents of Y, Hf, Zr, La, Ce, Ti in %).

The carbon content should be lower than 0.10% in order to ensure the processability. Too-low C contents cause increased costs in the manufacture of the alloy. The carbon content should therefore be higher than 0.001%.

Nitrogen is limited to 0.10%, since this element reduces the oxygen resistance. Too-low N contents cause increased costs in the manufacture of the alloy. The nitrogen content should therefore be higher than 0.0005%.

Manganese is limited to 0.20%, since this element reduces the oxygen resistance. Too-low Mn contents cause increased costs in the manufacture of the alloy. The manganese content should therefore be higher than 0.001%.

Even very low Mg contents improve the processing because of the binding of sulfur, whereby the occurrence of low-melting NiS eutectics is prevented. Thus a minimum content of 0.0001% is necessary for Mg. At too-high contents, intermetallic Ni—Mg phases may occur, which in turn significantly impair the processability. The Mg content is therefore limited to 0.08 wt %.

The oxygen content must be lower than 0.010% in order to ensure the manufacturability of the alloy. Too-low oxygen contents cause increased costs. The oxygen content should therefore be higher than 0.0001%.

The contents of sulfur should be kept as low as possible, since this interface-active element impairs the oxidation resistance. Therefore max. 0.015% S is defined.

Copper is limited to 0.80%, since this element reduces the oxidation resistance.

Just as Mg, even very low Ca contents improve the processing by the binding of sulfur, whereby the occurrence of low-melting NiS eutectics is prevented. Thus a minimum content of 0.0001% is necessary for Ca. At too-high contents, intermetallic Ni—Ca phases may occur, which in turn significantly impair the processability. The Ca content is therefore limited to 0.06 wt %.

Cobalt is limited to max. 0.50%, since this element reduces the oxidation resistance.

Molybdenum is limited to max. 0.20%, since this element reduces the oxidation resistance. The same is true for tungsten, niobium and also for vanadium.

The content of phosphorus should be lower than 0.050%, since this interface-active element impairs the oxidation resistance.

The content of boron should be kept as low as possible, since this interface-active element impairs the oxidation resistance. Therefore max. 0.020% B is defined.

Pb is limited to max. 0.005%, since this element reduces the oxidation resistance. The same is true for Zn, Sn and Bi.

The invention claimed is:

1. Nickel-based alloy, consisting of (in mass %)
Si 1.5-3.0%
Al 1.5-3.0%
Cr>0.1-3.0%, wherein 4.0≤Al+Si+Cr≤8.0 is satisfied for the contents of Si, Al and Cr in %,
Fe 0.005 to 0.20%,
Y 0.01-0.20%, 0.001 to 0.20% of one or more of the elements Hf, Zr, La, Ce, Ti, wherein 0.02≤Y+0.5*Hf+Zr+1.8*Ti+0.6*(La+Ce)≤0.30 is satisfied for the contents of Y, Hf, Zr, La, Ce, Ti in %,
C 0.001-0.10%
N 0.0005-0.10%
Mn 0.001-0.20%
Mg 0.0001-0.08%
O 0.0001 to 0.010%
S max. 0.015%
Cu max. 0.80%
Ni rest and the usual manufacturing-related impurities.

2. Alloy according to claim 1 with an Si content (in mass %) of 1.8 to 3.0%.

3. Alloy according to claim 1 with an Si content (in mass %) of 1.9 to 2.5%.

4. Alloy according to claim 1 with an Al content (in mass %) of 1.5 to 2.5%.

5. Alloy according to claim 1 with an Al content (in mass %) of 1.6 to 2.5%.

6. Alloy according to claim 1 with an Al content (in mass %) of 1.6 to 2.2%, especially 1.6 to 2.0%.

7. Alloy according to claim 1 with a Cr content (in mass %) of 0.8 to 3.0%.

8. Alloy according to claim 1 with a Cr content (in mass %) of 1.2 to 3.0%.

9. Alloy according to claim 1 with a Cr content (in mass %) of 1.9 to 3.0%, preferably 1.9 to 2.5%.

10. Alloy according to claim 1 wherein the formula 4.5<Al+Si+Cr<7.5 is satisfied for the contents of Si, Al and Cr in %.

11. Alloy according to claim 1 with an Fe content (in mass %) of 0.005 to 0.10%.

12. Alloy according to claim 1 with a Y content (in mass %) of 0.01 to 0.15%.

13. Alloy according to claim 1 with a Y content (in mass %) of 0.01 to 0.15% and 0.001 to 0.15% of one or more of the elements Hf, Zr, La, Ce, Ti, wherein 0.02<Y+0.5*Hf+Zr+1.8 Ti+0.6*(La+Ce)<0.25 is satisfied for the contents of Y, Hf, Zr, La, Ce, Ti in %.

14. Alloy according to claim 1 with a C content (in mass %) of 0.001 to 0.05% and with an N content (in mass %) of 0.001 to 0.05%.

15. Alloy according to claim 1 with an Mn content (in mass %) of 0.001 to 0.10%.

16. Alloy according to claim 1 with an Mg content (in mass %) of 0.001 to 0.08%.

17. Alloy according to claim 1 with a Ca content (in mass %) of 0.0001 to 0.06%.

18. Alloy according to claim 1 with a Co content of max. 0.50%, with a W content of max. 0.20%, with an Mo content of max. 0.20%, with an Nb content of max. 0.20%, with a V content of max. 0.20%, with a Ta content of max. 0.20%, a Pb content of max. 0.005%, a Zn content of max. 0.005%, an Sn content of max. 0.005%, a Bi content of max. 0.005%, a P content of max. 0.050% and a B content of max. 0.020%.

19. An electrode material for ignition elements of internal combustion engines, the electrode material comprising a nickel-based alloy according to claim 1.

20. The electrode material according to claim 19, wherein the electrode material is for ignition elements of gasoline engines.

* * * * *